US005288206A

United States Patent [19]

Bromann et al.

[11] Patent Number: 5,288,206

[45] Date of Patent: Feb. 22, 1994

[54] TURBO AERO ENGINE EQUIPPED WITH MEANS FACILITATING ADJUSTMENT OF PLAYS OF THE STATOR AND BETWEEN THE STATOR AND ROTOR

[75] Inventors: Alain M. L. Bromann, Savigny le Temple; Jean-Louis Charbonnel, le Mee sur Seine; Pierre Debeneix, St. Sauveur sur Ecole; Daniel J. Marey, Soisy Sur Seine; Jacky Naudet, Bondoufle; Thierry J. M. Niclot, Chilly Mazarin; Yann J. M. Rigaud, Pomponne, all of France

[73] Assignee: Societe Nationale d'Etude et de Construction de Moteurs d'Aviation S.N.E.C.M.A., Paris, France

[21] Appl. No.: 974,899

[22] Filed: Nov. 12, 1992

[30] Foreign Application Priority Data

Nov. 20, 1991 [FR] France ..... 91 14290

[51] Int. Cl.[5] ..... F04D 29/60

[52] U.S. Cl. ..... 415/209.2; 415/209.3

[58] Field of Search ..... 415/208.1, 209.1, 209.2, 415/209.3

[56] References Cited

U.S. PATENT DOCUMENTS

| | | | |
|---|---|---|---|
| 2,834,537 | 5/1958 | Neary | 415/209.2 |
| 2,910,269 | 10/1959 | Haworth et al. | 415/209.1 |
| 2,928,556 | 3/1960 | Hart | 415/209.1 |
| 3,024,968 | 3/1962 | Payne et al. | 415/209.1 |
| 4,875,828 | 10/1989 | Willkop et al. | 415/209.3 |
| 4,921,401 | 5/1990 | Hall et al. . | |
| 5,127,793 | 7/1992 | Wacker et al. | 415/209.2 |
| 5,141,395 | 8/1992 | Carroll et al. | 415/209.2 |
| 5,197,856 | 3/1993 | Koertge et al. | 415/209.2 |

FOREIGN PATENT DOCUMENTS

| | | | |
|---|---|---|---|
| 1140946 | 12/1962 | Fed. Rep. of Germany | 415/209.2 |
| 1426818 | 3/1969 | Fed. Rep. of Germany . | |
| 981975 | 6/1951 | France | 415/209.2 |
| 2509373 | 1/1983 | France . | |
| 342040 | 12/1959 | Switzerland . | |
| 2169962 | 7/1986 | United Kingdom . | |
| 2183296 | 6/1987 | United Kingdom . | |

*Primary Examiner*—John T. Kwon

*Attorney, Agent, or Firm*—Oblon, Spivak, McClelland, Maier & Neustadt

[57] ABSTRACT

A turbjet engine includes various elements for adjustment of play of the stator by having the stator heated or cooled by a gas. The outer housing to which the ferrule bearing the fixed vane stages is secured may be formed of two skins between which the gas is injected. The ferrule may be composed of sectors extending over one circumference fraction and fixed via their center and simply guided at their extremity; finally, it is possible to provide sealing devices between the outer housing and the support bearing surfaces of the ribs of the ferrule elements. The volume between the ferrule and the housing is then sectioned and is able to receive separate gas feedings for play adjustment.

11 Claims, 4 Drawing Sheets

FIG. 4
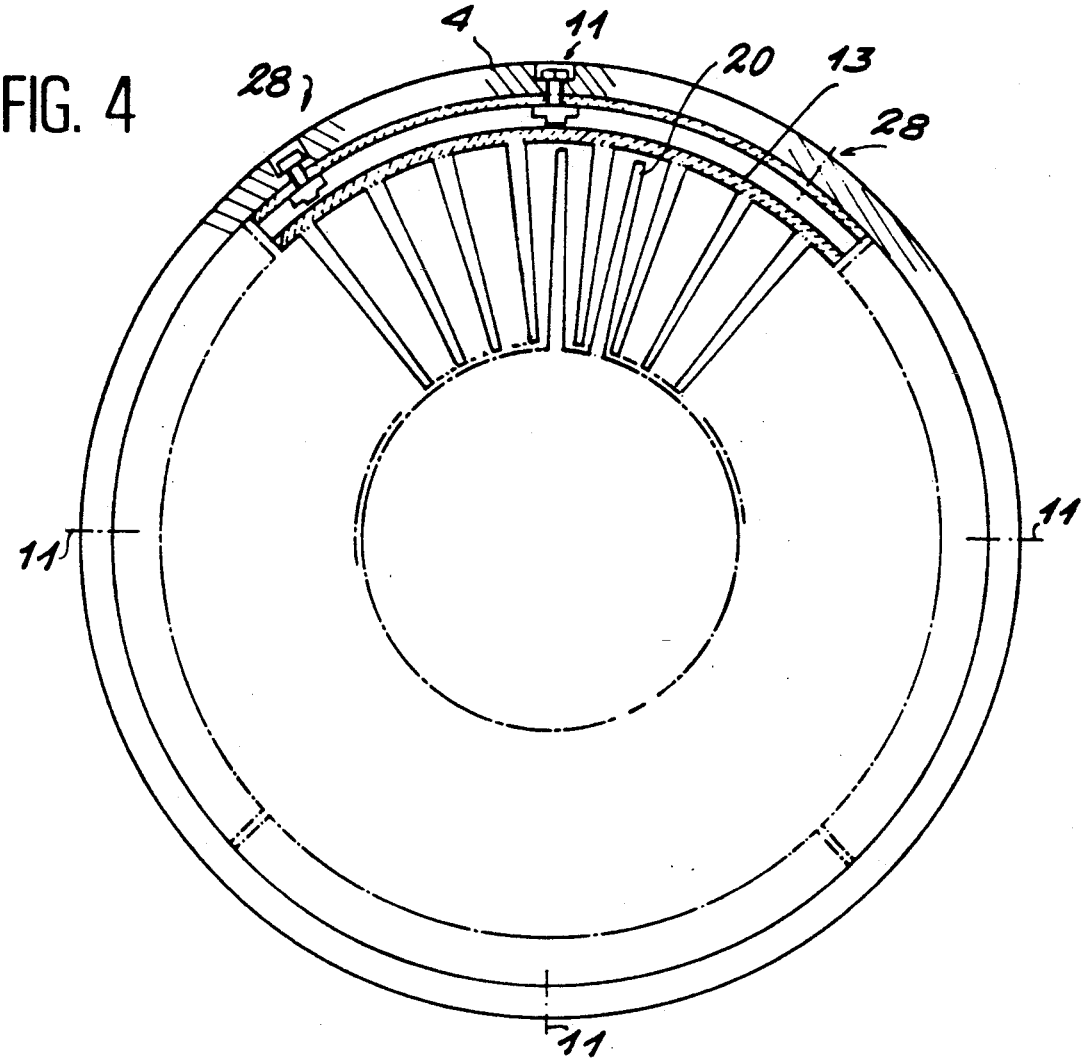
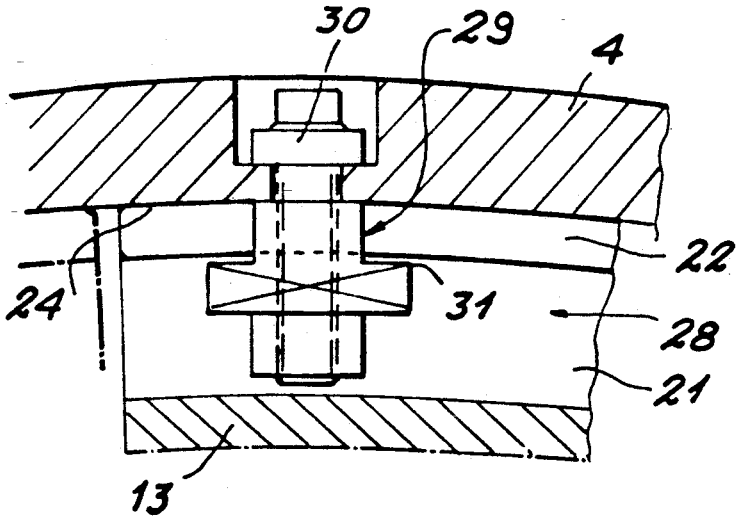
FIG. 4 A

TURBO AERO ENGINE EQUIPPED WITH MEANS FACILITATING ADJUSTMENT OF PLAYS OF THE STATOR AND BETWEEN THE STATOR AND ROTOR

FIELD OF THE INVENTION

The invention concerns a turbjet engine equipped with means for facilitating adjustment of plays between the various pieces constituting the stator or between the stator and the rotor.

BACKGROUND OF THE INVENTION

The considerable heat to which a turbojet engine of an airplane engine is subjected provokes thermic dilations and it is a considerable advantage to be able to adjust said dilations so as to in particular avoid any gas leaks and the resultant losses of efficiency. In particular, it is extremely important that the radial play, namely between the external extremities of the mobile vanes of the rotor and the internal ferrule of the stator bearing the fixed vanes for correcting the flow between the mobile vanes, is as small as possible. Two main means exist so as to obtain a satisfactory construction: producing the ferrules with a soft coating at the location in front of which the mobile vanes move so that any possible rubbing of the extremity of the mobile vanes, which would be produced by means of a higher dilation of said vanes, would result in wear of the coating and provoke a shaping of the stator at this location, or producing the stator in such a way that it is possible to have the gas circulate there and be taken from another location of the engine, for example, said gas being taken at a particular temperature and with a flow rate able to produce heating or cooling which governs the dilations of the ferrule and thus its play with the mobile vanes.

There is available a wide number of dispositions able to attain this objective with relative success. In one of the most related conceptions of the invention illustrated by the French patent No 1 003 299, the stator is provided, apart from one outer housing in the shape of a circular ring, with ferrule elements bearing fixed vanes and having the shape of a sector of a circle and merely covering one circumference fraction of the stator. The ferrule elements are juxtaposed in such a way that they are divided into groups, each group extending over the entire circumference of the stator, except for plays which extend between their extremities and which thus separate them. The ferrule elements are rigidly secured to the housing at a central location of the sector. This disposition has the advantage that the dilations of the ferrule elements may be easily adjusted without obtaining internal stresses by virtue of the discontinuity of the elements, but it means that the extremities are no longer supported and guided, which is likely to provoke damaging vibrations and prevents an accurate adjustment of the position of the ferrule elements.

SUMMARY OF THE INVENTION

The main object of the invention is to thus overcome this drawback, the invention being characterized in its most general form by pieces for guiding the extremities of the ferrule elements secured to the housing and including wings disposed in such a way as to keep the extremity portions of the ferrule elements against the housing in a radial direction, while enabling them to slide in the direction of the circumference.

According to another characteristic of the invention, which offers the advantage of allowing for fast and easy adjustment of the temperature of the stator without complicating its structure, a disposition is used in which the housing is composed of two concentric skins separated by blocks and equipped with means for controlling a circulation of gas between the two skins.

It is then possible for gas channel plates to extend between the two skins and in particular helical plates which produce increased uniformity of the current and temperatures.

It is possible to favor separation of the volume between the housing and the ferrule into compartments so as to firstly limit gas leaks and also to independently circulate cooling or heating gas in each compartment and thus obtain a different play adjustment as regards the various zones of the stator. If the adjustment is adapted in which the circular ribs separate the ferrule from the outer housing and offers good mechanical rigidity with the ribs being secured to the ferrule and resting on the housing via support edges, the imperviousness devices may be disposed between the rib support edges and the housing. It is possible to use separately or in combination flat joints introduced into circular slits created in the ribs and opening onto support bearing surfaces or circular projections penetrating into a throat filled with filling material, these means being mounted on the housing and on the ribs. The support edges situated at the extremities favorably constitute the portion supported by the wings.

One advantageous construction is able to be used when each ferrule element includes one pair of ribs extending on both sides of the location where the element is secured to the housing by means of a bolt or similar device. It is then preferable to scallop one rib of each pair by recesses which splinter the support bearing surfaces so that the possibilities of heat conduction between the housing and the ferrule are reduced. The imperviousness devices mentioned above and characteristic of the invention are then situated on the other rib.

An independent gas circulation device may then advantageously open into each sealed volume delimited by the ferrule elements, the ribs provided with the sealing device and the housing.

BRIEF DESCRIPTION OF THE DRAWINGS

There now follows a detailed description of the invention with the aid of the following accompanying figures, this description being given by way of non-restrictive example, said figures representing three main embodiments of the invention:

FIG. 4 is a diametrical sectional view of this embodiment;

DESCRIPTION OF THE PREFERRED EMBODIMENTS

Figure 1:
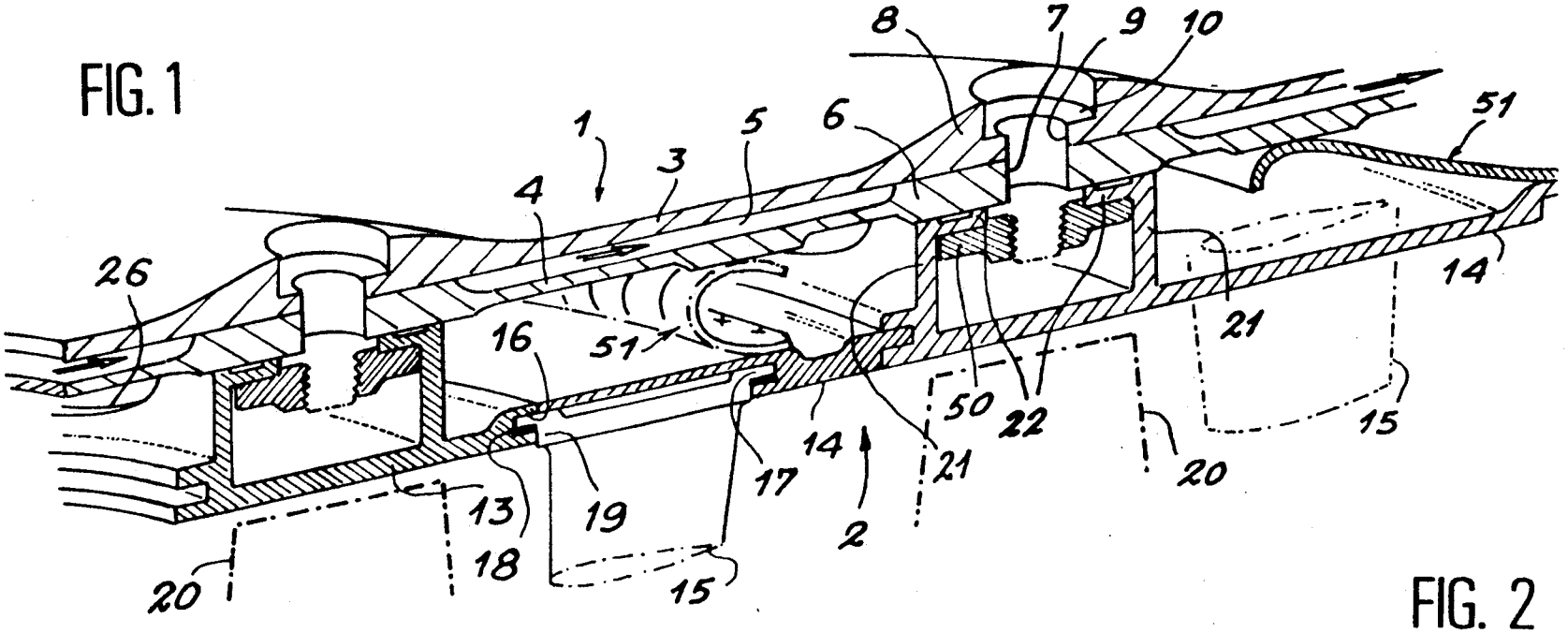
FIG. 1 shows a perspective view of an axial section of the machine of a first embodiment of the invention.
Figure 2:
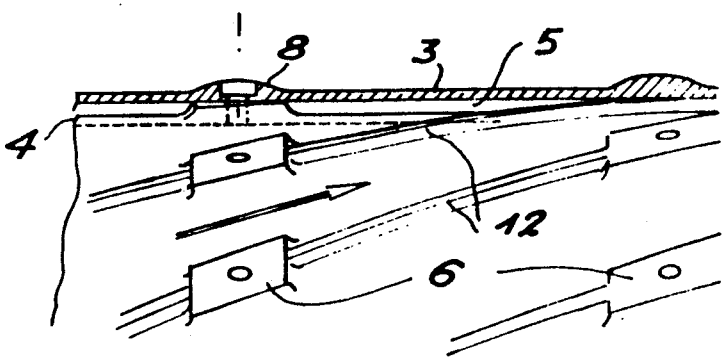
FIGS. 2 and 3 show two partial views of this embodiment.

In the first embodiment of the invention shown on FIG. 1, the stator is mainly composed of one external housing 1 extending around the rotor over one complete circumference and a ferrule 2. The external housing 1 is composed of two concentric skins 3 and 4 separated by an essentially ring shaped volume 5. The spacing between the skins 3 and 4 is ensured with the aid of blocks 6 distributed over the circumferences of the internal skin 4. The blocks 6 are traversed by a radial hole 7 and the external skin 3 is provided with external bosses 8 located in front of at least some of the blocks 6 and are traversed by another radial hole 9 opposite the corresponding radial hole 7 and ends outside via a countersink 10. The pair of elongation holes 7 and 9 are intended to each house a bolt 11 shown on FIGS. 4 and 6 so as to assemble the ferrule elements 2 on the external housing 1. The intermediate volume 5 is lined with gas channel pipes 12 (FIG. 2) having a spun or helical direction between the successive rows of blocks 6 so as to have the heating or cooling air circulate inside the intermediate volume 5 in a mainly axial direction but with a whirling component.

The ferrule 2 is composed of sectors 13 and 14 which alternate in the direction of the axis of the engine: the first are intended for linking to the external housing 1 and the second bear the fixed wings 15 of the rectification stages. The sectors 13 and 14 are assembled together by joints composed, for example, of a throat 16 on the first sectors 13, and a circular projection 17 on the second sectors 14 which is nested in a respective throat 16 with slight play which may be filled up by metal foil strip 18 intended to ensure imperviousness between the inside and outside of the ferrule 2 at this location. The circular projections 17 are constructed at the end of a slight horizontal flexure 19 with respect to the remainder of the second sectors 14 so that the internal face of the ferrule 2 is almost smooth. It is possible to dispense with the second sectors 14. The first sectors 13 would then be interconnected by the joints described above and would each bear a fixed vane stage 15.

Figure 3:
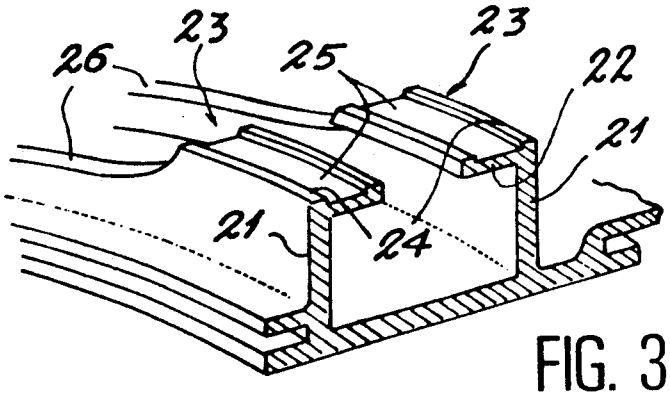

In the described embodiment, a mobile vane stage 20 belonging to the rotor rotates in front of each first sector 13. The first sectors 13 are each connected to the ring 1 by means of two circular ribs 21 and which extend radially and on both sides of the bolts 11, which may thus retain the cylindrical edges 22 disposed opposite each other at the extremity of the ribs 21 and which extend as an elongation. As shown in FIG. 3, the edges 22 have on their external face 23 support bearing surfaces, in this case reduced at the longitudinal extremities of the edges 22 as the external faces 23 are formed of two parallel crests 24 separated by a hollow space 25. The ribs 21 are further scalloped, that is recesses 26 split up the edges 22 and the support bearing surfaces 23, which only extend onto the relatively small portions of the circumferences. The hollow spaces 25 and the recesses 26 make it possible to limit the heat exchange and contact surface between the external housing 1 and the ferrule 2. If it is desired to partion off the volume between the external housing 1 and the ferrule 2, it is possible to use flat joints 51 with ring-shaped plates in the free state and with one extremity being secured to the external face of the second sectors 14. The other extremity is directed towards the internal face of the internal skin 4 and the width of the flat joints 51 is sufficient so that they are compressed and bent inwards between the external housing 1 and the ferrule 2.

The edges 22 are retained by the nuts 50 of the bolts 11 and pressed against the internal skin 4. FIG. 4 also shows that the first sectors 13 are two or four in number, for example, on one circumference and they are each connected by one of the bolts 11 to the external housing 1 via a location at the center of their extent. The first sectors 13 are thus juxtaposed along the circumference of the stator so that the extremities 27 of the first two consecutive sectors 13 are distant by a certain play which leaves a free flow to the dilations of the first sectors 13. The second sectors 14 may be of any number and differ from that of the first segments 13 along one circumference.

The play between two consecutive segments 13 is partially occupied by a guiding piece 28 comprised of a sleeve 29 connected by bolts 30 to the internal skin 4, and wings 31 extending from the internal extremity of the sleeve 29 in the direction of the circumference so as to cover the edges 22 at the extremities 27 and keep them against the internal skin 4. Thus, the first segments 13 are prevented from bending so that the extremities 27 would draw close to the center of the engine and reach the mobile vanes 20. The guiding pieces 28 do, however, enable the extremities 27 to move freely in the direction of the circumference resulting from the thermic dilations. The distance between the wings 31 and the internal skin 4 is in fact slightly larger than the thickness of the edges 22.

Figure 5:
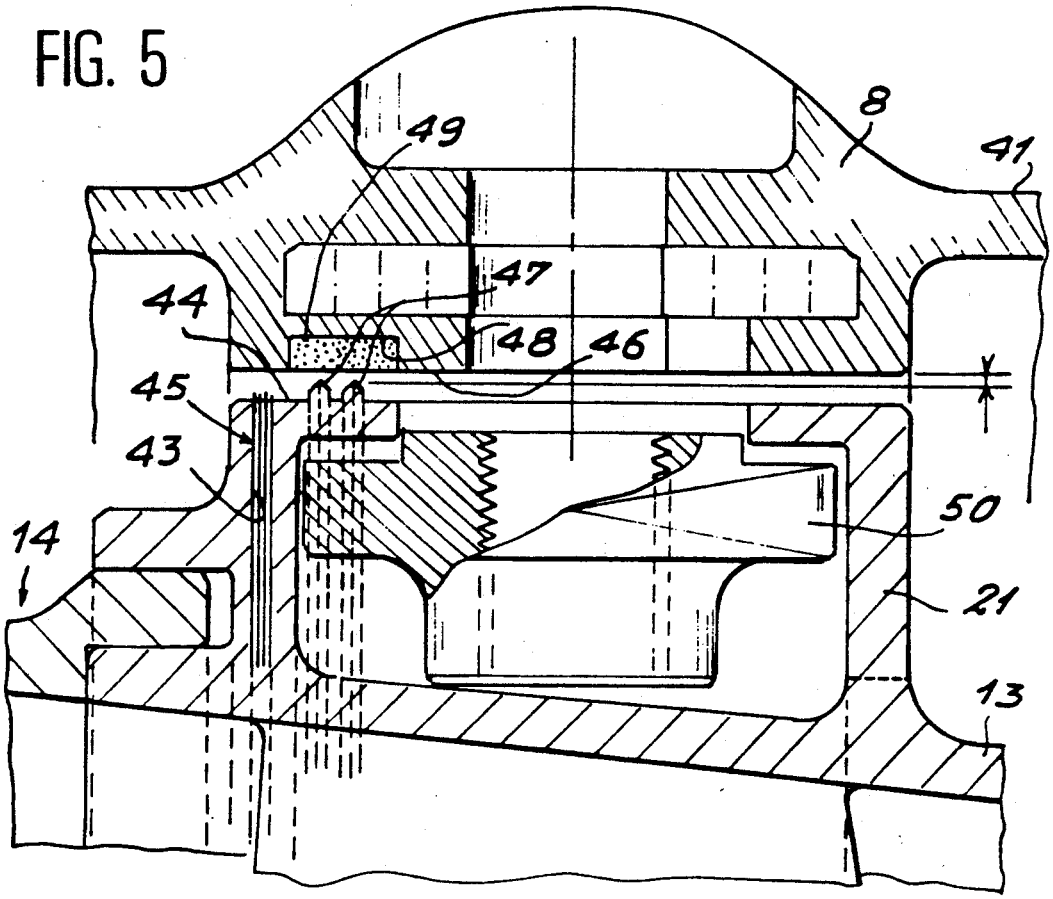
FIGS. 5 and 6 show an axial sectional view of another embodiment of the invention, the pieces being shown separated and assembled respectively.
Figure 6:
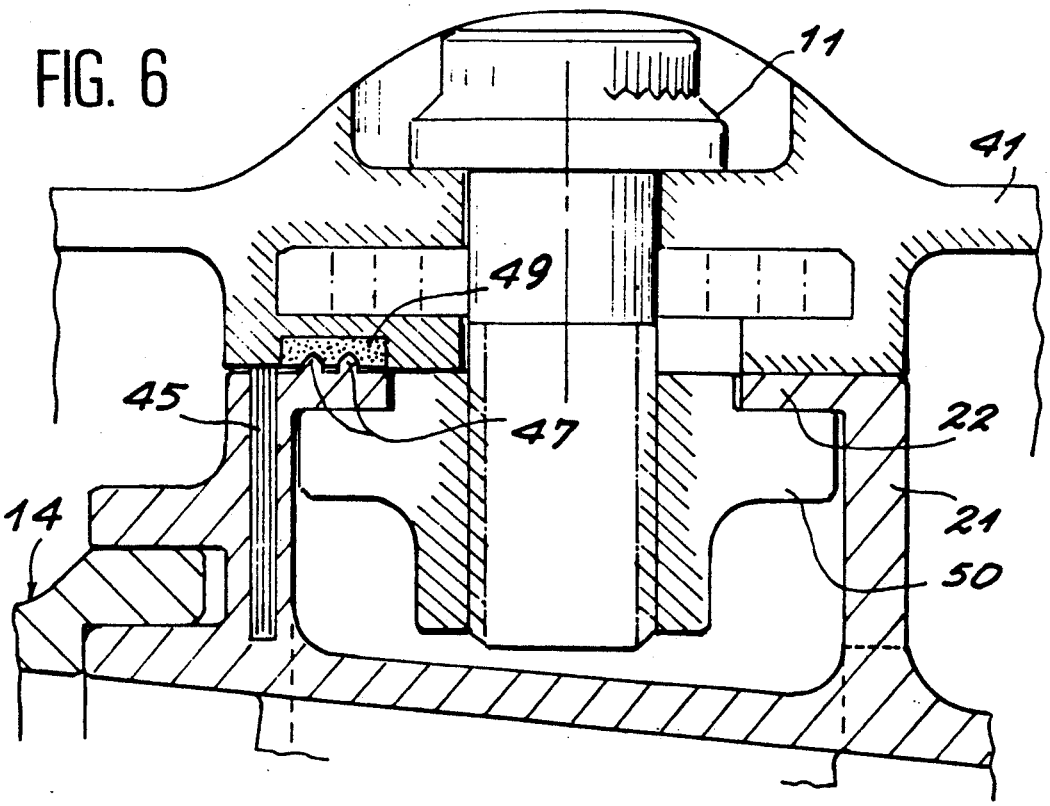

A further embodiment of the invention shown on FIGS. 5 and 6 comprises a certain number of identical elements or elements almost the same as those of the preceding embodiment and are given the same reference numbers. The guiding pieces 28 are not shown in these two figures but are identical to those of the preceding embodiment. However, the external housing, here given reference number 41, is all of one piece and in particular does not include any double skin intended for circulation of cooling air. It is preferable in this instance to adjust the plays by injecting the air into the compartments delimited by the sectors 13 and 14, the external housing 41 and the sealing devices installed on some of the ribs (here given the reference 42) and the first sectors 13.

The ribs 42 are provided with a sealing device in the direction of the circumference. This device consists of a slit 43 installed according to the height of the rib 42 and which opens onto the support bearing 44 against the external housing 41. The slit 43 includes a flat circular joint 45 composed of blades so that the support bearing 46 belonging to the external housing 41 radially compresses towards the inside. Another sealing device, which may be added to the previous one, consists of sharp-ended circumferential projections 47, referred to by the applicant as "lechettes", which point from the support bearing 44 of the ribs 42 and which penetrate into a throat 48 hollowed in the other support bearing surface 46. The throat 48 is filled with a filling made of a feltlike material compressed by the circumferential projections 47. Thus, a labyrinth joint is formed.

Mounting is effected by firstly placing the segments 13 and 14 of one stage of the machine around the rotor, then the external housing 1 is heated so as to slightly dilate it, and is wound around the segments 13 and 14 which are then screwed. The support bearing surface 46 has temporarily a larger diameter than that of the circumferential projections 47. This state is shown on FIG. 6. This method makes it possible to use an external housing 41 whose elements extend over complete circumferences.

The volume delimited by the external housing 41 and the ferrule sectors 13 and 14 is thus sectioned off by the ribs into almost complete separate volumes, except for the plays at the extremities 27 of the sectors 13. These plays may moreover be partially filled up by other sealing joints, for example if the joints 45 project from the ribs 42 in the direction of the circumference. The gas leaks between these various compartments are then reduced to a minimum and the external housing 41 may then be perforated (FIG. 7) so as to receive air blowing orifices 53 which open into a respective compartment. Feeding is then advantageously independent for each compartment, whereas the usual solution consists of taking via a pipe 54 air from one point of the turbojet engine and injecting it into the volume between the external housing 41 and the ferrule 2. In this instance, it is preferable and useful to provide a valve 56 on each of the branchings uniting the pipe 54 to each of the compartments, and all the valves 56 are controlled independently by means of an automatic control system 57 which continuously modifies their opening according to the desired temperature in each compartment so as to adjust the plays to the desired level. Thermometers placed at suitable locations provide information to the automatic control system 57.

Figure 7:
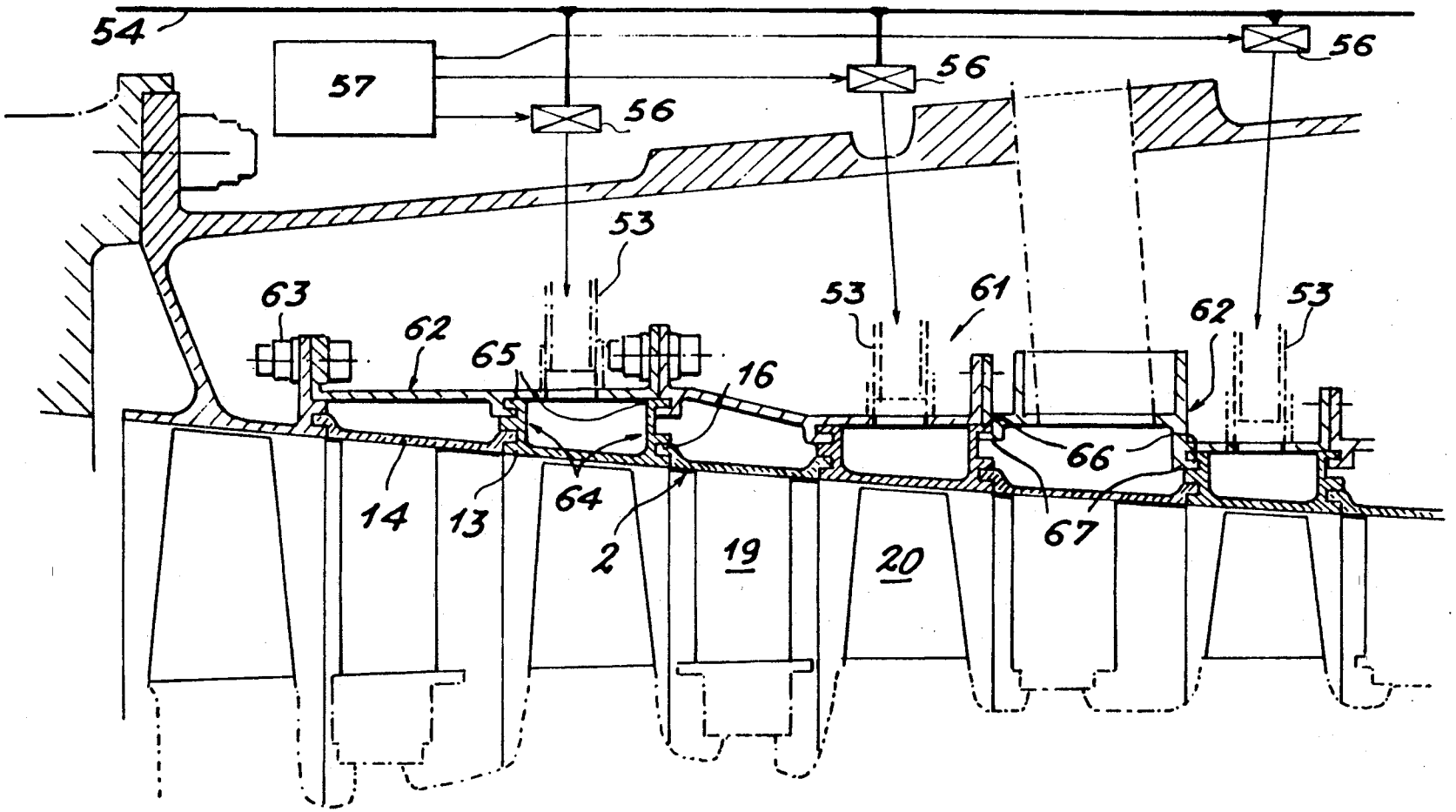
FIG. 7 shows a general view of a third embodiment of the invention.

This device of FIG. 7 may be easily utilized for the embodiment of FIGS. 5 and 6, but is shown here in a possible third embodiment where the external housing 61 is composed of ring-shaped elements 62 connected to bolts 63 and extended in such a way that each of them surrounds one first sector 13 and one second sector 14. The first sectors 13 have two ribs 64 on their longitudinal edges and each include a throat 16 (already mentioned) so as to support one second sector extremity 14 and one external longitudinal edge 65; the external longitudinal edges 65 of each first sector 13 are orientated in opposing directions. Furthermore, each annular element 62 includes two throats 66 disposed around angle steel wings 67 disposed on their rear face so that, when the stator is mounted, the two longitudinal projections 65 of a given sector 13 are kept inside a throat 66 of one annular element 62 and one throat 66 of an adjacent annular element 62. Metal foil strips are here again introduced into the assembling plays so as to fill them up and prevent leaks. The angle steel wings 67 extend at least in front of the extremities of the ferrule sectors 13 so as to keep them against the external housing 61 in the same way as for the guiding pieces 28. The fixing of the ferrule sectors 13 at their center may be carried out as for the first embodiment by providing the ribs 64 with an internal edge similar to the edge 22 and kept in place by a nut.

The ribs 64 may in this instance also be scalloped; the imperviousness of the compartments is then re-established by elastic blade joints (not shown) which are compressed and bent back between the annular elements 62 and the second sectors 14.

All these embodiments of the invention thus have in common the characteristic of simply and effectively allowing for adjustment of the plays between the mobile vanes 20 and the stator.

What is claimed is:

1. Turbojet engine which comprises:

a stator which includes one external circular housing and a ferrule bearing fixed vanes mounted on sectors of a circle-shaped elements covering one portion of the circumference of the stators, the ferrule having elements surrounded by the housing and rigidly fixed to the housing at a central location of the sectors and juxtaposed with a predetermined degree of play at circumferential extremities thereof so as to be divided into groups each extending over substantially the full circumference of the stator, wherein guiding pieces of the extremities of the ferrule elements are fixed to the housing and include wings disposed in such a way as to keep the extremity portions of the ferrule elements against the housing in a radial direction, while enabling said elements to slide in a circumferential direction.

2. Turbojet engine according to claim 1, wherein the housing comprises two concentric skins separated by blocks and includes means for circulating gas between the two skins.

3. Turbojet engine according to claim 2, wherein the means for circulating air include gas channel plates extending between the two skins.

4. Turbojet engine according to claim 3, wherein the gas channel plates are helical.

5. Turbojet engine according to claim 1, wherein the circular ribs separate the ferrule elements from the housing, and the ribs are fixed to the ferrule elements and rest on the housing via support edges having extreme portions which form sections supported by the wings.

6. Turbojet engine according to claim 5, wherein the sealing devices are disposed between the support edges of the ribs and the housing.

7. Turbojet engine according to claim 6, wherein the sealing devices include flat joints introduced into circular slots created in the ribs and opening onto the support edges.

8. Turbojet engine according to claim 6, wherein the sealing device include circular projections established on the housing and the ribs and which penetrate into a throat filled with filling material

9. Turbojet engine according to claim 6, wherein an independent gas blowing device opens into each sealed volume delimited by the ferrule, the ribs provided with the sealing devices and the housing.

10. Turbojet engine according to claim 5, wherein each ferrule element includes one pair of ribs extending on both sides of the location where the ferrule element is secured to the ring.

11. Turbojet engine according to claim 10, wherein at least one of the ribs of each pair is scalloped with recesses which split up the support bearing surfaces.

* * * * *

UNITED STATES PATENT AND TRADEMARK OFFICE

CERTIFICATE OF CORRECTION

PATENT NO. : 5,288,206

DATED : February 22, 1994

INVENTOR(S) : Alain M. L. Bromann et al.

It is certified that error appears in the above-indentified patent and that said Letters Patent is hereby corrected as shown below:

On the title page, Item [54] and Column 1, Line 2, the title should read as follows:

--TURBOJET ENGINE EQUIPPED WITH MEANS FOR FACILITATING ADJUSTMENT OF PLAYS OF THE STATOR AND BETWEEN THE STATOR AND ROTOR--

Signed and Sealed this

Twenty-first Day of June, 1994

Bruce Lehman

*Attest:*

BRUCE LEHMAN

*Attesting Officer*

*Commissioner of Patents and Trademarks*